US005938474A

United States Patent [19]

Nelson

[11] Patent Number: 5,938,474

[45] Date of Patent: Aug. 17, 1999

[54] CONNECTOR ASSEMBLY FOR A COAXIAL CABLE

[75] Inventor: James W. Nelson, Cheshire, Conn.

[73] Assignee: Radio Frequency Systems, Inc., Marlboro, N.J.

[21] Appl. No.: 08/987,994

[22] Filed: Dec. 10, 1997

[51] Int. Cl.[6] ..... H01R 9/05

[52] U.S. Cl. ..... 439/583; 439/578

[58] Field of Search ..... 439/429, 578, 439/583, 584, 805, 587, 588, 589

[56] References Cited

U.S. PATENT DOCUMENTS

| | | | |
|---|---|---|---|
| 4,824,400 | 4/1989 | Spinner | 439/578 |
| 4,915,651 | 4/1990 | Bout | 439/578 |
| 5,137,470 | 8/1992 | Doles | 439/578 |
| 5,154,636 | 10/1992 | Vaccaro et al. | 439/583 |
| 5,183,412 | 2/1993 | Nagafuji | 439/578 |
| 5,310,359 | 5/1994 | Chadbourne et al. | 439/462 |
| 5,439,393 | 8/1995 | Watson | 439/578 |
| 5,454,735 | 10/1995 | Nelson | 439/578 |
| 5,795,188 | 8/1998 | Harwath | 439/583 |
| 5,830,009 | 11/1998 | Tettinger | 439/584 |

*Primary Examiner*—Lincoln Donovan
*Attorney, Agent, or Firm*—Ware, Fressola, Van Der Sluys & Adolphson LLP

[57] ABSTRACT

In a coaxial cable having a hollow inner-conductor, a connector assembly is provided for electromagnetically connecting the hollow inner-conductor and outer-conductor of the coaxial cable to a standard connector. In one disclosed embodiment, the connector assembly is formed from a body having an axial opening extending therethrough and an outer conductor contact portion. A dielectric cylinder is disposed within the axial opening of the body of the outer-conductor contact, the dielectric cylinder is provided with an axial opening extending therethrough. The assembly is further formed from an inner-conductor contact having a nose portion, a bridge portion adjacent to said nose portion, a shoulder portion adjacent to said bridge portion, a pin portion adjacent to said shoulder portion, wherein the bridge portion has a diameter which is smaller than the shoulder portion and the nose portion so as to define a groove therebetween and wherein the pin portion of the inner-conductor contact is disposed within the axial opening of the dielectric cylinder. A radial spring contact resides within the groove. The connector assembly of the present invention provides the advantage of allowing the inner-conductor contact to be installed in the body prior to connecting the assembly to the cable which reduces the chance of inner-conductor contact misalignment, among other things. The spring contact insures good electrical connection between the inner-conductor and the inner-conductor contact.

9 Claims, 5 Drawing Sheets

CONNECTOR ASSEMBLY FOR A COAXIAL CABLE

BACKGROUND OF THE INVENTION

1. Field of the Invention

The present invention relates generally to connectors for coaxial cables, and more particularly, to connectors for coaxial cables having corrugated hollow inner-conductors.

2. Description of the Prior Art

A coaxial cable is typically terminated by a connector assembly which makes contact with both the inner-conductor and outer-conductor of the cable. Such a connector assembly provides a means for connecting the cable to another device. The connector assembly usually has an outer-conductor contact and an inner-conductor contact. Normally, the inner-conductor contact is first attached to the inner-conductor and then the outer-conductor contact is attached to the outer-conductor. During attachment of the outer-conductor contact, the inner-conductor contact is positioned within the outer-conductor contact so that the inner-conductor contact is supported therein. Under this assembly procedure, axial misalignment of the inner-conductor contact can result causing poor electrical performance, among other things. To reduce the possibility of such misalignment, some prior art connector assemblies utilize two mating parts to connect the inner-conductor to the connector assembly; one part is installed in the inner-conductor and the other part is affixed to the outer-conductor contact. By using two mating parts to connect the inner-conductor to the connector assembly, misalignment problems are reduced but not eliminated. Also, one problem with the connector assembly design having a two mating part inner-conductor contact is that more parts and assembly time are required, which increases the costs of using and manufacturing such a connector assembly.

SUMMARY OF THE INVENTION

Accordingly, it is an object of the present invention to provide a coaxial cable connector assembly for connecting a coaxial cable to another connector.

It is also an object of the present invention to provide a connector assembly with a minimum number of parts.

It is a further object of the present invention to reduce inner-conductor misalignment problems.

It is still a further object of the present invention to provide a connector assembly which permits accurate location of the inner-conductor relative to the body of the outer-conductor.

The foregoing objectives are realized by the connector assembly of the present invention which includes an inner-conductor contact having a nose portion, a bridge portion adjacent to said nose portion, a shoulder portion adjacent to said bridge portion, a pin portion adjacent to said shoulder portion, wherein the bridge portion has a diameter which is smaller than the shoulder portion and the nose portion so as to define a groove therebetween. A spring contact means resides within the groove of the inner-conductor contact to provide electrical contact between the inner-conductor and the inner-conductor contact when the connector assembly is connected to a coaxial cable.

Other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include.

DETAILED DESCRIPTION OF THE INVENTION

The apparatus of the present invention may be used for connecting coaxial cables to other cables or devices such as antennas and the like. Turning now to the drawings, in FIG. 1 there is shown a typical coaxial cable 10 having a helically corrugated inner-conductor 11 concentrically spaced from center line A—A, an outer-conductor 12 disposed about the inner-conductor 11 and concentrically spaced from center line A—A. The space between the inner-conductor 11 and the outer-conductor 12 is filled by a dielectric spacer 13. As FIG. 1 further illustrates, the helically corrugated inner-conductor has a root diameter Dr, a wall diameter Dw and a corrugation depth Cd, which is half the difference between the wall diameter Dw and the root diameter Dr. As those skilled in the art will appreciate, coaxial cable connectors are normally affixed to a cable by a two step process wherein in the first step, an inner-conductor contact is attached to the inner-conductor and then an outer-conductor contact is attached to the outer-conductor. While the outer-conductor contact is being attached, care must be taken to avoid misalignment of the inner-conductor contact which is usually held, after assembly, within the body of the outer-conductor contact. The connector assembly of the present invention, which will now be described, is suitable for making an electrical connection with both the outer-conductor and the inner-conductor at substantially the same time, thereby reducing, if not eliminating, the potential for misalignment of the inner-conductor contact.

Figure 1:
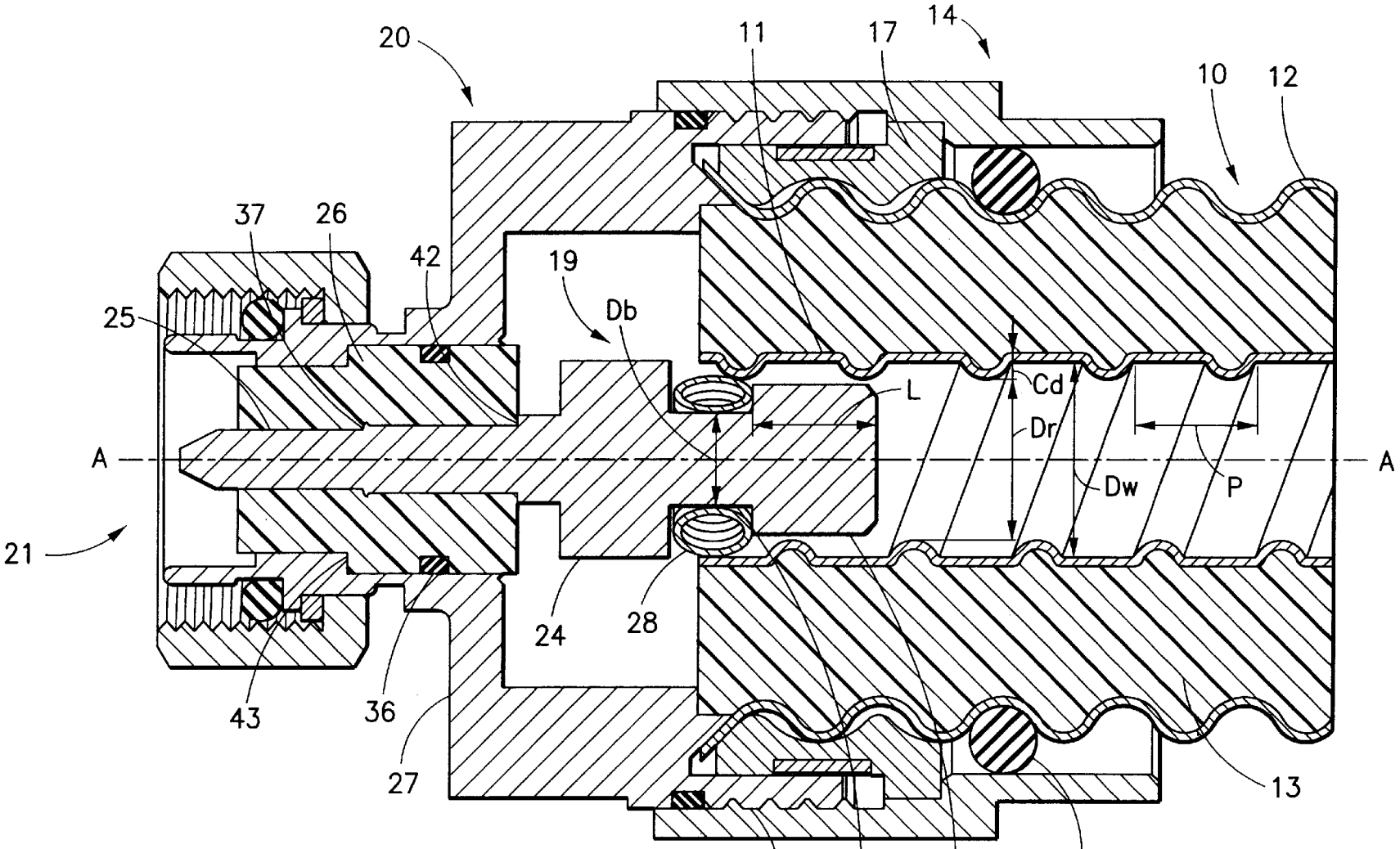
FIG. 1 which is a cross-sectional view of a coaxial cable, spring contact and body of the present invention having outer and inner conductor contacts in an assembled state.
Figure 2B:
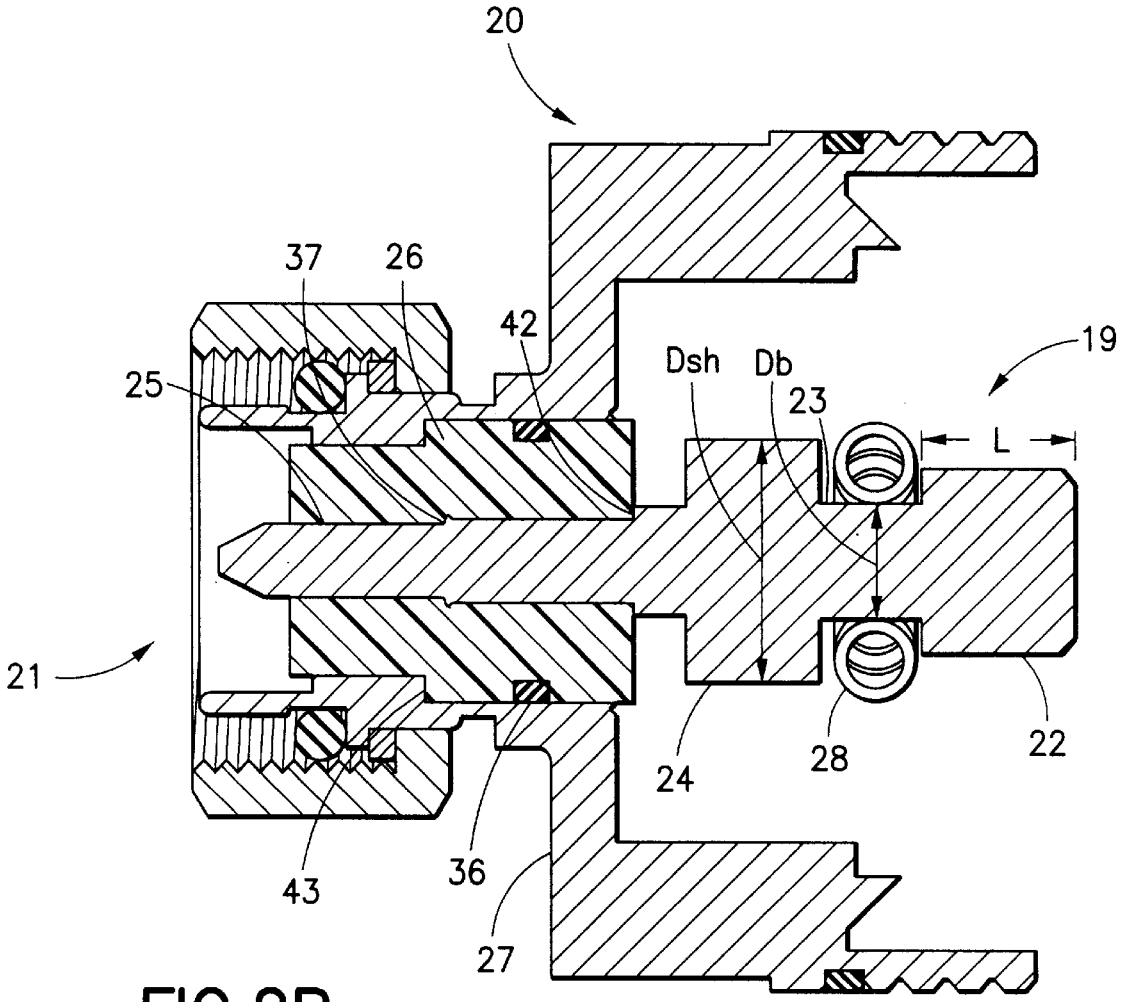
FIG. 2B which is a cross sectional view of the spring contact and body of a first embodiment.
Figure 2A:
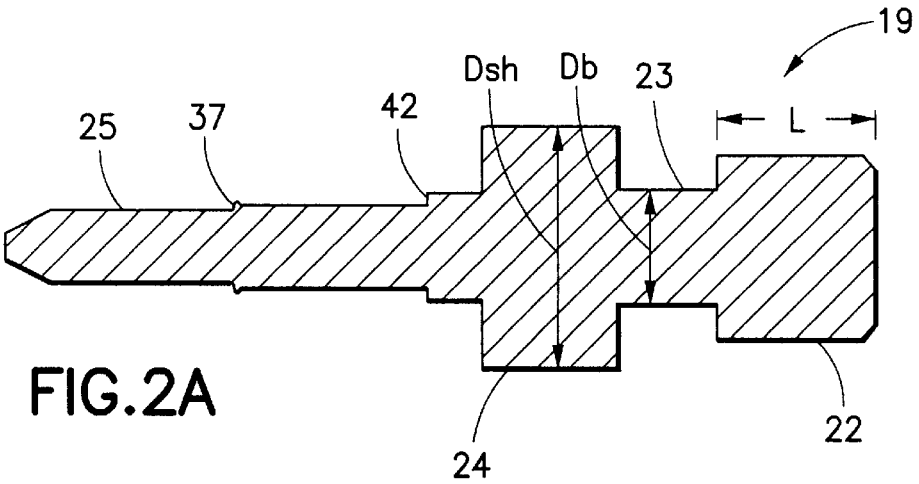
FIG. 2A, which is a cross-sectional view of the inner-conductor contact.

As shown in FIGS. 1, 2A and 2B, a first embodiment of the connector assembly of the present invention includes an inner-conductor contact 19 (FIG. 2A) which has a nose portion 22, a narrow bridge portion 23, a shoulder portion 24, and a pin portion 25. The narrow bridge portion 23 located between the nose and shoulder portions forms a groove in which a radial coil spring contact 28 resides. The purpose of the nose portion 22 of the inner-conductor contact 19 is to center the contact 19 in the inner-conductor 11. In the case where the inner-conductor 11 is corrugated, as shown in FIG. 1, the nose prevents the spring contact 28 from forcing the inner-conductor contact 19 and the body 20 out of axial alignment with the inner-conductor 11. The diameter of the nose portion 22 is selected so as to be less than the root diameter Dr of the inner-conductor 11, but large enough to prevent the spring contact 28 from moving over the nose portion 22 and off the inner-conductor contact 19 during removal of the body 20 from the cable 10. If the inner-conductor 11 is helically corrugated, the length L of the nose portion 22 is preferably at least as long as one pitch P of the corrugation in order to properly center the inner-conductor contact 19 and the body 20 during installation of the body 20 to the cable 10.

As shown in FIG. 2A, adjacent to the nose portion 22 is the bridge portion 23 which has a diameter Db small enough to prevent the spring contact 28, having a similar inside diameter Dsi, from moving over the nose portion 22 and off the inner-conductor contact 19 during removal of the body 20 from the cable 10. Diameter Db is made large enough to assure electrical contact between the spring contact 28 and the inner-conductor 11, and between the spring contact 28 and the bridge portion 23 and/or the shoulder portion 24 when the inner-conductor contact 19 is inserted in the inner-conductor 11.

Moving to the left in FIG. 2A along the inner-conductor contact 19, the shoulder portion 24 is located adjacent to the bridge portion 23 at an end opposite of the nose portion 22. The shoulder portion diameter Dsh is made sufficiently large to prevent the spring contact 28 from moving over the shoulder portion 24. As stated above, the nose portion 22, bridge portion 23 and shoulder portion 24 define a groove within which the spring contact 28 resides.

Adjacent to the shoulder portion 24 is the pin portion 25. The pin portion 25 is formed to suit the particular device (not shown) to be connected to the body 20. In the embodiment shown in FIG. 2B, the end of the pin portion 25 which is not in contact with the shoulder portion is formed according to the requirements of a Din-type standard connector 21, but may be formed to the specifications of a different type of connector. The pin portion 25, shoulder portion 24, and bridge portion 23 and nose portion 22 are constructed from a conductive material.

A dielectric cylinder 26, made from a dielectric material (such as polytetrafluoroethylene) having an axial opening therethrough is disposed over the pin portion 25 for the purpose of insulating the inner-conductor contact 19 from the outer-conductor contact 27. The dielectric cylinder 26 may be press-fit onto the pin portion 25 as shown in FIG. 2. As shown in FIGS. 1 and 2, a barb 37 and pin abutment 42 prevent the pin portion 25 from moving with respect to the dielectric cylinder 26 disposed thereover.

The connector assembly of the present invention further includes a cylindrically shaped body 20 having an outer-conductor contact portion 27 and an axial opening therethrough. The dielectric cylinder 26 disposed over the pin portion of the inner-conductor contact 19 is positioned within opening in the body 20. In order to provide a tight seal between the body 20 and the dielectric cylinder 26, a gasket 36 is provided between the body 20 to prevent moisture from entering the inner-conductor 11. As shown in FIGS. 1, 2A and 2B, a dielectric abutment 43 and the gasket 36 prevent the dielectric cylinder 26 from moving with respect to the body. Once the dielectric cylinder 26 is positioned within the opening in the body, the connector assembly of the present invention is ready to be attached to the coaxial cable.

Attachment of the connector to the cable is made by attaching the outer conductor contact 27 to threads 15 of a standard backnut 14. The backnut 14 is prevented from slipping over the end of the cable by a split ferrule 17. Ordinarily, an O-ring seal 16 is positioned between the backnut 14 and the outer-conductor 12 to seal out moisture, dirt and other contaminants.

As shown in FIG. 1, the outer-conductor contact 27 is threaded into the backnut 14, the body 20 holds the pin portion 25, shoulder portion 24, bridge portion 23 and nose portion 22 of the inner-conductor contact 19 radially and axially in place relative to the body 20. In order to reduce noise due to intermittent contact in the signal being transmitted by the inner-conductor 11 to the contact 19, the axial position of the inner-conductor contact 19 is fixed relative to the outer-conductor contact 27 to assure that electromagnetic contact is made between inner-conductor contact 19 and the inner-conductor 11 only through the spring contact 28 and not directly with the shoulder portion 24.

Although FIG. 1 shows an outer-conductor contact 27 having external threads suitable for engaging the internal threads of the backnut 14, the mechanism incorporated into the outer-conductor contact 27 to connect the outer-conductor contact 27 to the backnut 14 may vary according to the connecting means provided by the backnut 14.

Figure 3B:
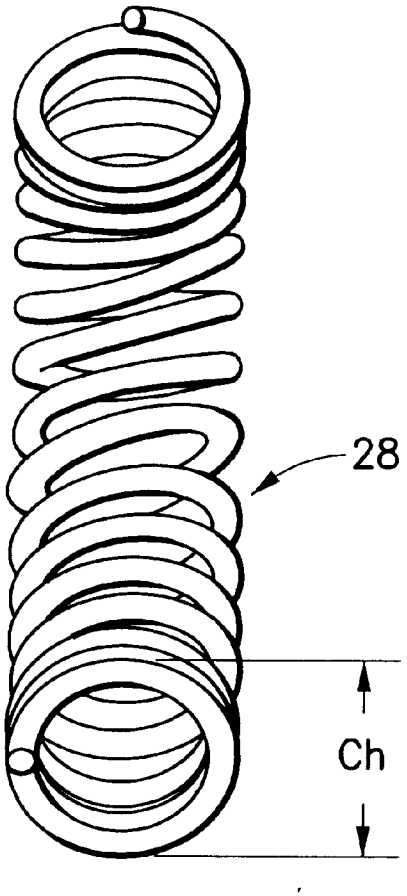
FIG. 3B, which is a partial sectional view of the spring contact.
Figure 3A:
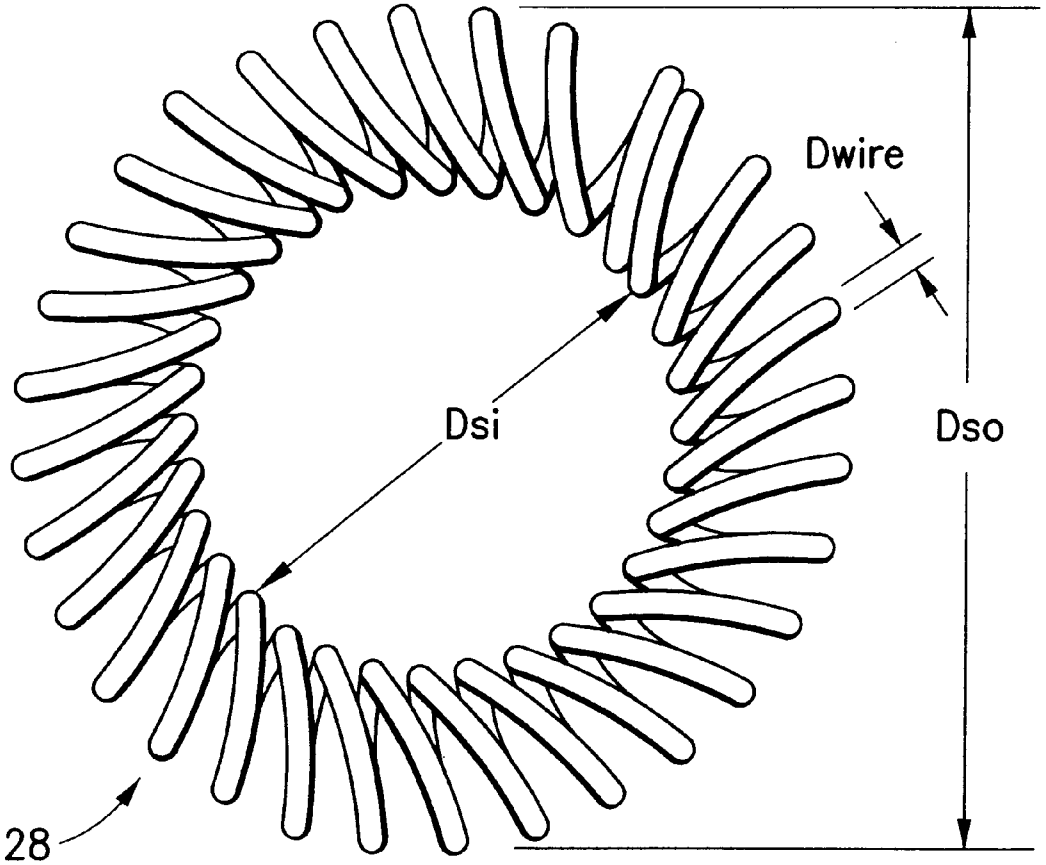
FIG. 3A which shows a front view of the spring contact.

FIGS. 3A and 3B show the over-all diameter Dso, coil height Ch and wire diameter Dwire of the spring contact 28, all three of which can be adjusted to suit the particular type of inner-conductor 11 used. For example, if the inner-conductor 11 is helically corrugated, the over-all diameter Dso, coil height Ch and wire diameter Dwire are preferably selected to allow the spring contact 28 to sufficiently compress in order to contact the root diameter Dr of the corrugated inner-conductor 11, and to allow the spring contact 28 to have sufficient contact force where the spring contact 28 contacts the wall diameter Dw of the inner-conductor 11.

Figure 4:
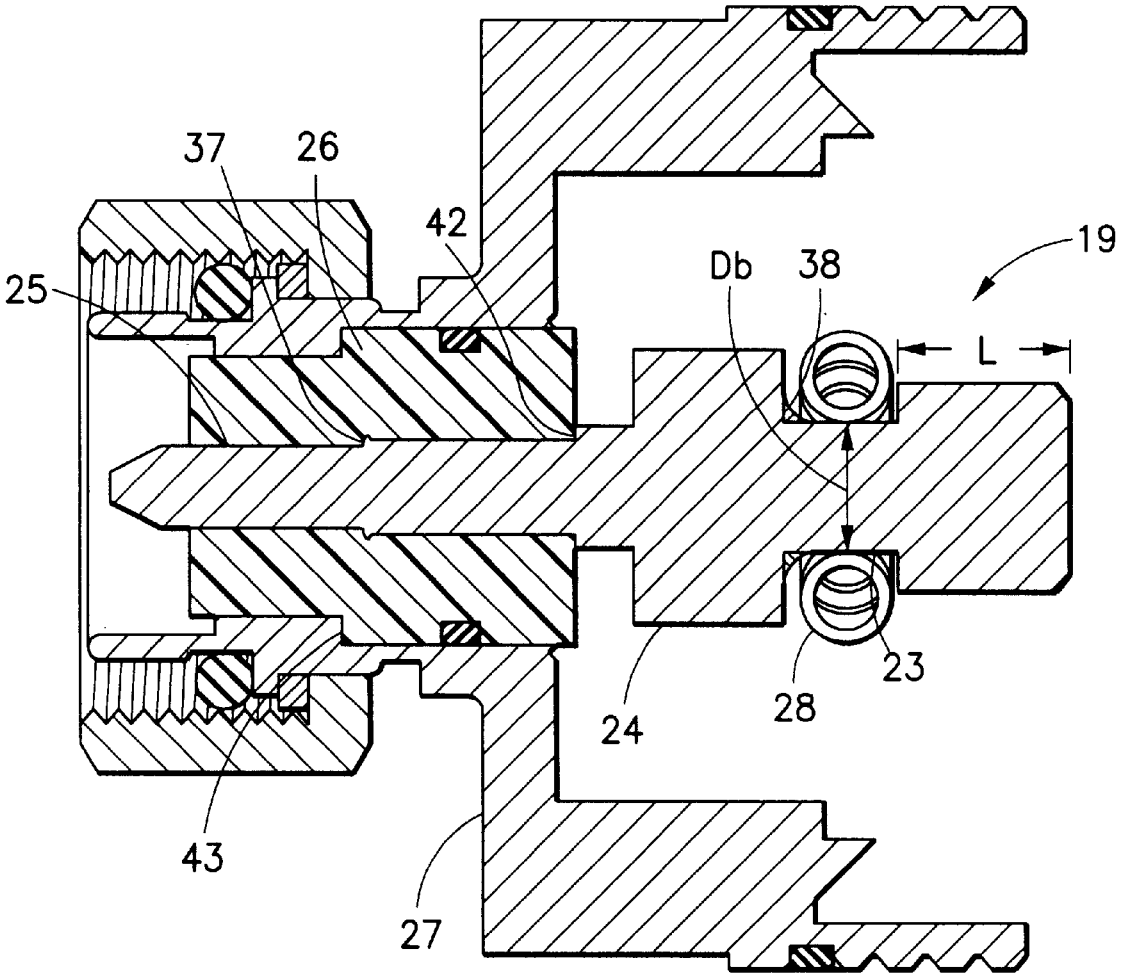
FIG. 4 which is a cross-sectional view of the body, spring contact and fillet of a second embodiment.
Figure 5:
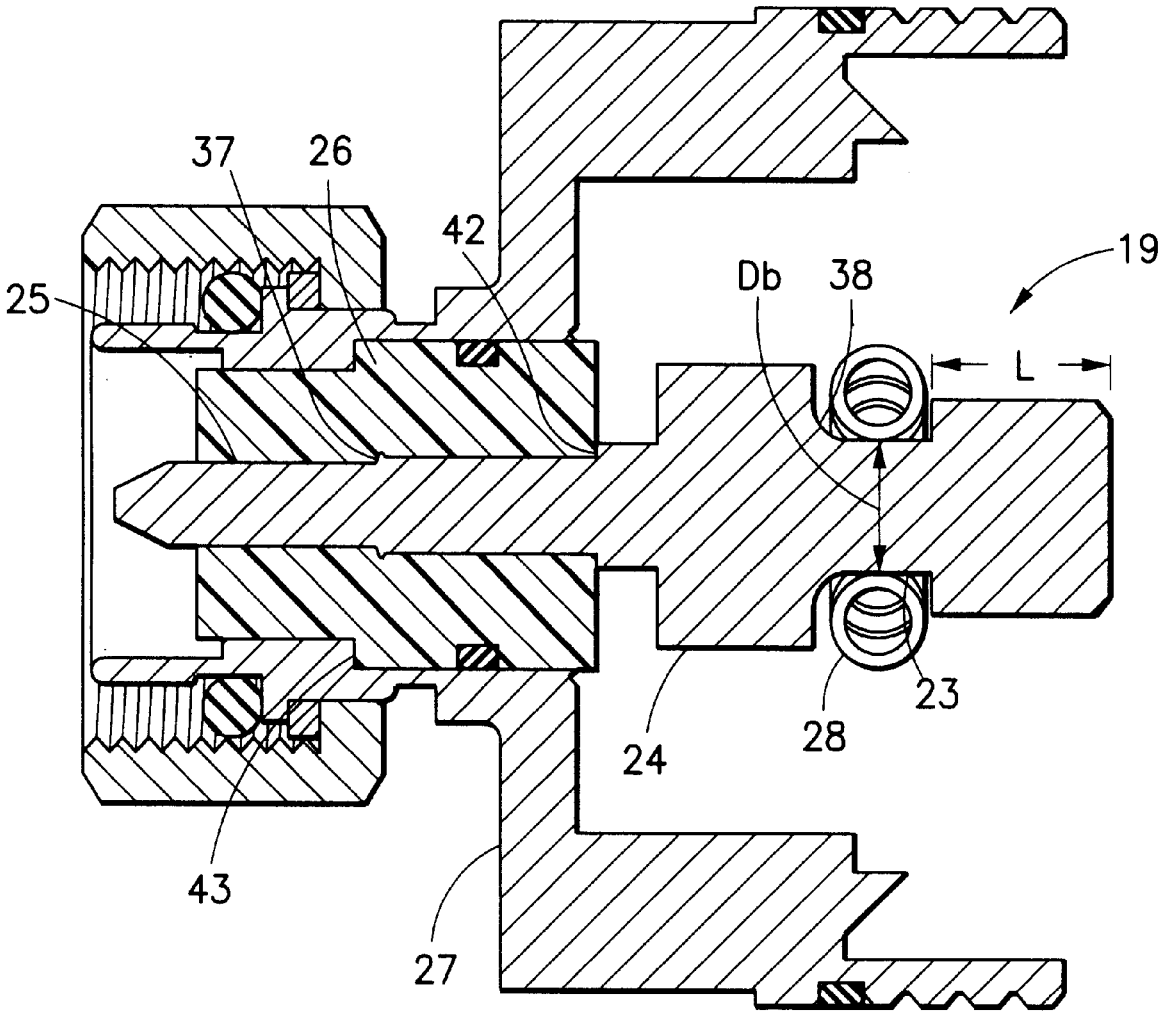
FIG. 5 which is a cross-sectional view of the body and spring contact of a third embodiment.

A second embodiment is depicted in FIG. 4, which differs from the embodiment shown in FIGS. 2A and 2B in that a fillet 38 has been added at the corner between the bridge portion 23 and the shoulder portion 24. A third embodiment is illustrated in FIG. 5, wherein instead of adding a fillet as in the second embodiment, the body 20 has been formed in such a manner that the inner-conductor contact 19 has the same cross section as the second embodiment. The second and third embodiments provide a curved transition 29 between the bridge portion 23 and the shoulder portion 24 resulting in better electromagnetic contact between the spring contact 28 and the inner-conductor contact 19 because the spring contact will tend to be pushed towards the shoulder when the inner-conductor contact is inserted into the inner-conductor.

The body 20 generally shown in FIGS. 1, 2A and 2B has a Din-type standard connector 21 suitable for connecting the body 20 to a mating Din-type connector (not shown). The present invention is not limited to the use of a Din-type standard connector; other types of connectors may be substituted to accommodate different requirements.

As can be seen from the foregoing detailed description of the preferred embodiments of the invention, the body 20 provides a means of electromagnetically connecting the hollow inner-conductor 11 and outer-conductor 12 of a coaxial cable 10 while reducing the chance of axial misalignment because the inner-conductor contact is already installed in the body prior to the attachment of the connector to the cable. In addition, the body 20 described herein reduces the number of parts required to connect a coaxial cable 10; fewer parts reduces assembly time and reduces the chance that essential parts will be lost. Finally, although FIG. 1 depicts the present invention in conjunction with a helically corrugated inner-conductor, the present invention will work equally well with inner-conductors having other corrugation patterns, or inner-conductors having a smooth inner surface.

Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. A connector assembly for a coaxial cable having a hollow inner-conductor and an outer-conductor, the connector assembly comprising:

a body having an axial opening extending therethrough and an outer conductor contact portion for providing electrical contact with the outer-conductor;

a dielectric cylinder disposed within the axial opening of the body of the outer-conductor contact, the dielectric cylinder further having an axial opening extending therethrough;

an inner-conductor contact having a nose portion at one end, a bridge portion adjacent to said nose portion, a shoulder portion adjacent to said bridge portion, and a pin portion at an opposite end adjacent to said shoulder portion, wherein the bridge portion has a diameter which is smaller than the shoulder portion and the nose portion so as to define a groove therebetween and wherein at least a part of the pin portion of the inner-conductor contact is disposed within the axial opening of the dielectric cylinder; and a spring contact means residing within the groove of the inner-conductor contact for providing electrical contact between the inner conductor and the inner conductor contact.

2. The connector assembly of claim 1, wherein the spring contact means is a radially compressible coil spring having inner and outer diameters sufficient to permit the radially compressible coil spring to touch both the bridge portion and the inner-conductor when the nose portion of the inner-conductor contact is inserted into the inner-conductor.

3. The connector assembly of claim 1 wherein the bridge portion and the shoulder portion form a corner and wherein a fillet is placed over the corner.

4. An inner-conductor contact assembly for use in a coaxial cable connector assembly, the inner conductor contact assembly comprising:

an inner-conductor contact having a nose portion at one end, a bridge portion adjacent to said nose portion, a shoulder portion adjacent to said bridge portion, and a pin portion at an opposite end adjacent to said shoulder portion, wherein the bridge portion has a diameter which is smaller than the shoulder portion and the nose portion so as to define a groove therebetween; and a spring contact means residing within the groove of the inner-conductor contact for providing electrical contact between the inner conductor and the inner conductor contact.

5. The connecting member of claim 4, wherein the spring contact means is a radially compressible spring having inner and outer diameters sufficient to permit the spring to touch both the bridge portion and the inner-conductor when the nose portion of the inner conductor connector is inserted in the inner-conductor.

6. The connecting member of claim 4 further comprising a fillet added at a corner created by said bridge portion and said shoulder portion so.

7. A connector assembly for a coaxial cable having a hollow inner-conductor and an outer-conductor, the connector assembly comprising:

means for electrically contacting the outer-conductor, the means having an axial opening therein;

an inner-conductor contact having a nose portion at one end, a bridge portion adjacent to said nose portion, a shoulder portion adjacent to said bridge portion, and a pin portion at an opposite end adjacent to said shoulder portion, wherein the bridge portion has a diameter which is smaller than the shoulder portion and the nose portion so as to define a groove therebetween;

a spring contact means residing within the groove of the inner-conductor contact for providing electrical contact between the inner conductor and the inner conductor contact; and means for insulating the inner conductor contact from the means for contacting the outer-conductor, the means being disposed within the axial opening in the outer-conductor contacting means and disposed about at least part of the pin portion of the inner-conductor contact.

8. The connector of claim 7, wherein the spring contact means is a radially compressible spring having inner and outer diameters sufficient to permit the spring to touch both the bridge portion and the inner-conductor when the nose portion of the inner conductor contact is inserted in the inner-conductor.

9. The connector of claim 7 further comprising a fillet added at a corner created by said bridge portion and said shoulder portion so.

* * * * *